US006530192B2

(12) United States Patent
Buckley et al.

(10) Patent No.: US 6,530,192 B2
(45) Date of Patent: Mar. 11, 2003

(54) ENVELOPE STRIPPING APPARATUS

(75) Inventors: Franklin J. Buckley, Bethel, CT (US); Christopher D. Clark, Lempster, NH (US); Robert P. Rebres, Southbury, CT (US); Kenneth A. Schulz, Bethel, CT (US); Steven A. Supron, Middlebury, CT (US); Geoffrey S. Coleman, Ansonia, CT (US)

(73) Assignee: Pitney Bowes Inc., Stamford, CT (US)

( * ) Notice: Subject to any disclaimer, the term of this patent is extended or adjusted under 35 U.S.C. 154(b) by 68 days.

(21) Appl. No.: 09/750,988

(22) Filed: Dec. 28, 2000

(65) Prior Publication Data

US 2002/0083687 A1 Jul. 4, 2002

(51) Int. Cl.[7] ..... B65B 43/26
(52) U.S. Cl. ..... 53/381.7; 53/381.6
(58) Field of Search ..... 53/381.7, 381.6, 53/569; 271/309

(56) References Cited

U.S. PATENT DOCUMENTS

| | | | | | |
|---|---|---|---|---|---|
| 2,028,277 | A | | 1/1936 | Finfrock | 156/147.1 |
| 2,302,261 | A | | 11/1942 | Ryan | 156/441.5 |
| 3,015,926 | A | * | 1/1962 | Galambos | 493/319 |
| 3,885,785 | A | * | 5/1975 | Burkett et al. | 271/197 |
| 3,941,037 | A | * | 3/1976 | Reichert | 493/167 |
| 4,318,265 | A | | 3/1982 | Orsinger et al. | 53/492 |
| 4,450,037 | A | | 5/1984 | Gavronsky | 156/441.5 |
| 4,551,188 | A | * | 11/1985 | Schulze | 156/441.5 |
| 4,595,190 | A | * | 6/1986 | Amarakoon | 271/161 |
| 4,597,570 | A | * | 7/1986 | Huggins | 271/94 |
| 4,638,986 | A | * | 1/1987 | Huggins et al. | 271/108 |
| 4,776,152 | A | | 10/1988 | Kruk | 53/492 |
| 4,926,787 | A | * | 5/1990 | Fassman et al. | 118/264 |
| 5,052,875 | A | * | 10/1991 | Miller et al. | 271/2 |
| 5,178,715 | A | * | 1/1993 | Rehberg | 156/441.5 |
| 5,385,627 | A | | 1/1995 | Weimer | 156/441.5 |
| 5,489,358 | A | | 2/1996 | Miciukiewicz | 156/366 |
| 5,544,579 | A | | 8/1996 | Gallagher et al. | 101/91 |
| 5,665,198 | A | * | 9/1997 | Bieber et al. | 156/441.5 |
| 5,924,265 | A | * | 7/1999 | Auerbach | 53/381.6 |
| 6,041,569 | A | | 3/2000 | Freeman et al. | 53/131.2 |
| 6,406,591 | B1 | * | 6/2002 | Beckstrom et al. | 118/268 |

* cited by examiner

*Primary Examiner*—Rinaldi I. Rada
*Assistant Examiner*—Louis Tran
(74) *Attorney, Agent, or Firm*—Brian A. Lemm; Angelo N. Chaclas; Charles R. Malandra, Jr.

(57) ABSTRACT

An envelope stripping apparatus is disclosed for opening and holding open the flaps of envelopes or mail processed in a mailing machine or other envelope-processing machine. The flaps of the envelopes are held down against a vacuum plenum during transport of the envelope. The envelopes are fed along the feeding path towards a moistening device while the flap is stripped and held by the vacuum plenum. An arrangement of the plenum apertures is such that stiffer portions of the flaps have more vacuum applied than those that are of lesser area, or at the extreme end of the flap. A second arrangement of the envelope flaps will cause additional holding of the end of the flap if it is a larger envelope with a greater area at the end such as a square flap.

8 Claims, 12 Drawing Sheets

ENVELOPE STRIPPING APPARATUS

FIELD OF THE INVENTION

This invention relates to envelope printing equipment such as that used in envelope printing and processing machines. It particularly applies to a mailing machine that separates, feeds and transports mail along a feeding path that includes a moistening and sealing device prior to being printed with a postal indicia. The mail or envelope may have to be stripped in advance of moistening the flap at the moistening device; therefore, a stripper blade is employed to separate the flap from the body of the envelope. In the present invention, the apparatus and process include a vacuum plenum employed to hold the envelope flap down during advancement of the envelope through the system. The vacuum hold-down is used to insure that the flap is out of the way when the envelope's leading end approaches the stripping blade, thereby preventing any potential jam.

BACKGROUND OF THE INVENTION

The present invention involves an envelope processing machine such as a mailing machine. The mailing machine has been available in many forms, being able to process mail and envelopes of all sizes, and types since Arthur Pitney and Walter Wheeler Jr. of Pitney Bowes Inc. began developing these machines. The older equipment and that of the present age utilize a moistening device for the envelope or mail flaps. The moistening apparatus identified with the equipment depends upon being able to separate the envelope or mail flap from the body of the envelope. Once separated, a stripper blade may be utilized to keep the flap away from the body of the envelope, thereby allowing a moistening device to apply the necessary sealant or water to the glued portion of the flap.

The present invention is used in the new mailing equipment of today in order to prevent jams of the envelopes being transported through the mailing machine feeding path. In spite of the advancements sometimes seen in the prior art, there is still a severe tendency of the mailpiece and mailpiece flap (envelope flap) to easily jam in the mailpiece transport area. This especially happens at the stripper blade, typically used to separate the envelope or mailpiece flap from the body of the envelope. Unpredictable attitudes of the flap during the transport process will inevitably permit some portion of the mailpiece flap to catch on the wrong components. The intent is to have the flap smoothly transition through the area where the stripper blade is located. To do this requires firmly establishing the location of the flap during the transport process. Therefore, the present invention uses a vacuum plenum in order to hold the envelope flap down while the envelope moves downstream in the system thereby preventing any jam potential. The present invention has shown that it is possible to reduce jams at the stripper blade mechanism by positively positioning the envelope flap against a surface that guides the flap beneath the stripping blade. This insures that the stripping blade will be in position between the inside of the envelope flap and the body of the remainder of the envelope or mailpiece.

This new vacuum system is applied where stripping of the envelope flap needs to be accomplished reliably in order to optimize the performance of the machine, and for providing a properly sealed envelope.

SUMMARY OF THE INVENTION

The present invention provides an envelope flap stripping apparatus for mailing machines, or other business machines or equipment handling envelopes to be moistened. The invention includes an envelope transport system supported on a fixed structure or frame the fixed structure further supporting a vacuum plenum unit comprised of a chamber-like box that is sealed except where there are vacuum applying apertures. The vacuum plenum unit has a plenum cover mounted and secured to the chamber-like box. The plenum cover has a series of parallel apertures in the surface that are aligned along the envelope or mailpiece feed path to intercept an on-coming envelope or mail-piece. The series of parallel apertures are spaced apart to be generally parallel to a registration wall of the mailing machine structure while they are generally parallel to the feed deck of the mailing machine. There are a number of groups of apertures in the plenum that are larger than others, being strategically placed to open, hold and continuously acquire each envelope flap. The greater holding potential of the vacuum source is greater near the registration wall where the envelope flap is hinged, as well as at an outboard position relative to the registration wall of the machine. There is a greater need for additonal holding force at those locations. The vacuum applied through the plenum apertures grab and continue to acquire the envelope or mailpiece flap moving past the plenum unit so that the downstream stripper blade can properly enter the space between the body of the envelope and the envelope flap.

In another embodiment of the present invention, the envelope flap is held down by an application of negative pressure while a positive supply of pressure is applied to the inside surface of the opened envelope flap. This is another way to insure the envelope flap is aligned to an open position, in order to be intercepted by a stripper blade assembly.

In yet another embodiment of the present invention, there is a positionable plenum deflector that either directs the envelope to a non-stripping position, or to a stripping position. The plenum deflector holds the envelope flap to an open position while the envelope is advanced towards a receiving path that includes a stripper blade.

BRIEF DESCRIPTION OF THE DRAWINGS

The above background and brief description of the advantages of the present invention will be apparent upon consideration of the following detailed description when taken in conjunction with accompanying drawings. In the accompanying drawings, like reference characters refer to like parts throughout, and in which.

DETAILED DESCRIPTION OF THE PRESENT INVENTION

Figure 1:
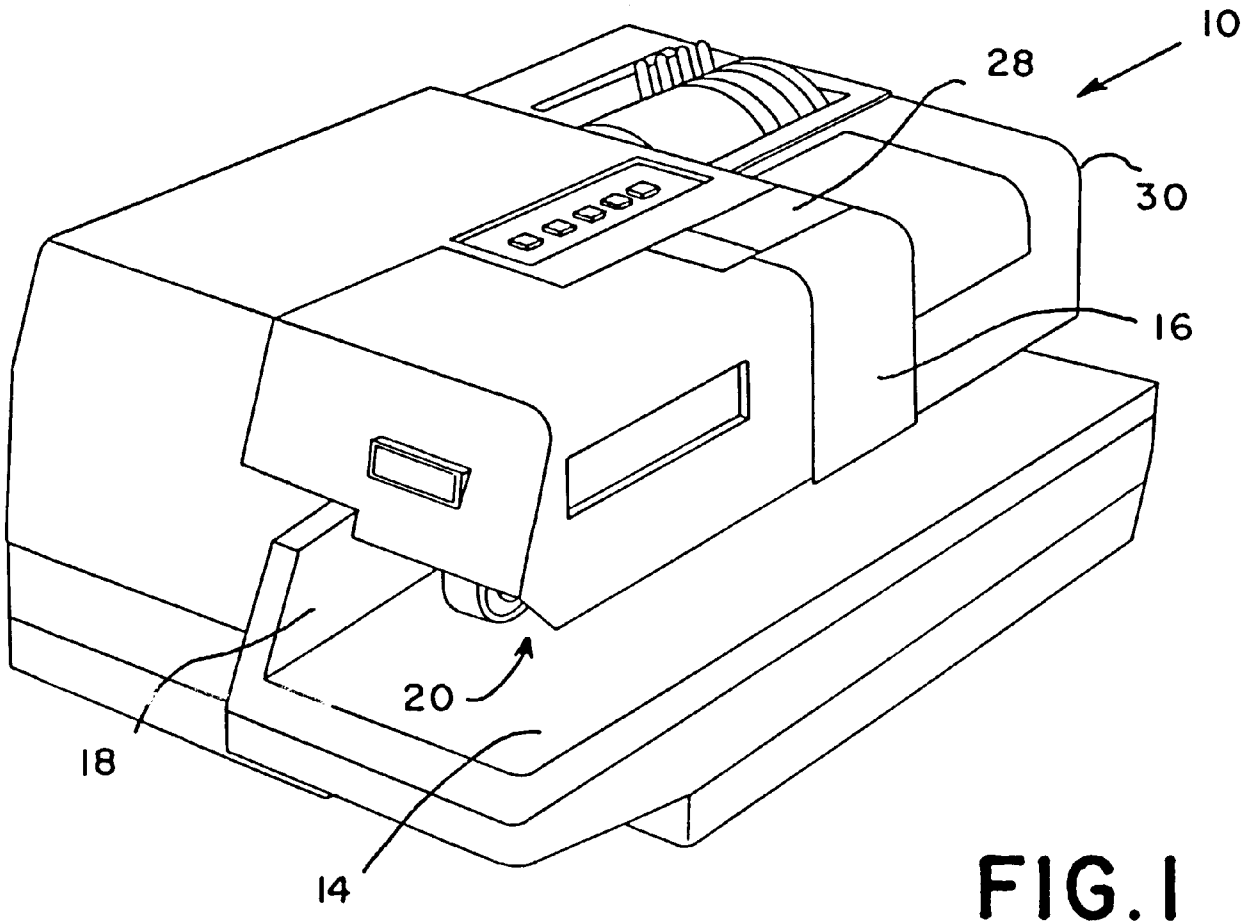
FIG. 1 is a perspective view of a mailing machine within which the present invention is utilized.

Referring to FIG. 1, there is shown an isometric view of a mailing machine 10. The mailing machine 10 is typical of that illustrated in other Pitney Bowes Inc. patents such as U.S. Pat. No. 6,041,569 in that there is typically an input feeding deck 14, and machine structure that supports the feeding deck as well as the accompanying functional components. There is a cover 16 generally lying over the area housing the present invention, and other instrumentality's such as an input separation and feeding apparatus 20. The feeding device 20 and associated components are seen better in FIG. 2, where there is a feeding roller 24, and an overlying separation belt 26. There is a registration wall 18, typical of such mailing equipment, as it is to guide and register the upper side of each envelope being processed. (The upper side of the envelope is typically the side where the flap is joined to the body of the envelope, and the flap is typically located beneath the printed address portion of the envelope). This will provide the proper placement of the postal indicia on the address side of the envelope, and provide an opportunity to strip and moisten the envelope flap).

Figure 3:
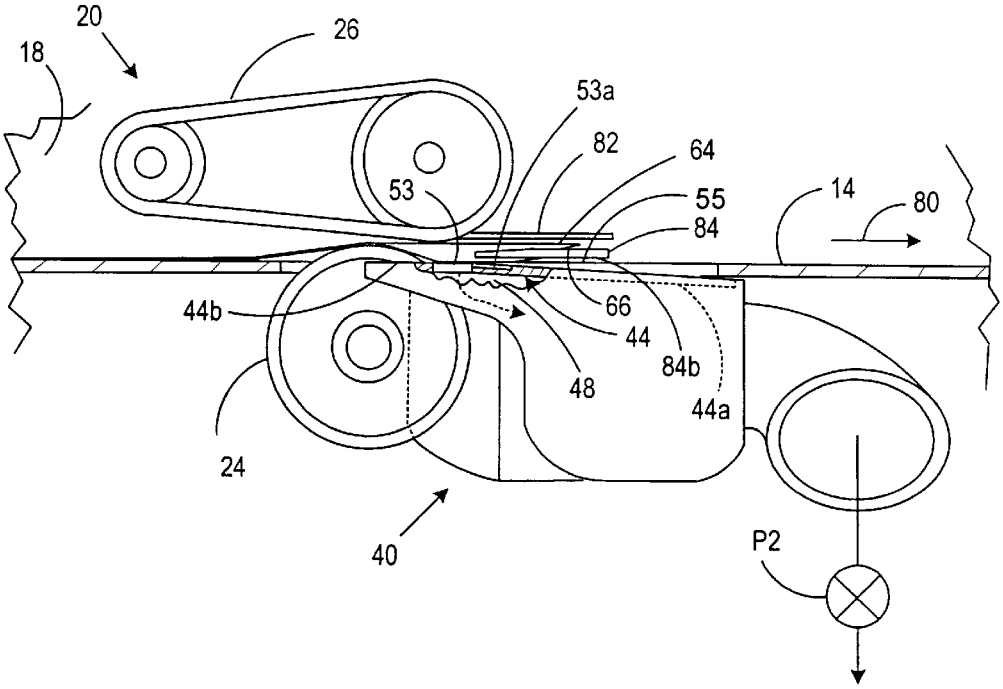
FIG. 3 shows an elevation view of the mailing machine of FIG. 1.

Located immediately downstream to the input separation and feeding device 20, there is an inker compartment 28, which for the purposes of the present specification will be understood to supply ink for a downstream located postage meter 30. Referring now to FIG. 3, the area concerning the present invention may be seen as a machine operator would view the front portion of the mailing machine 10. There is a plenum unit 40, (also considered a flap holding apparatus) which is secured to the machine 10 structure (generally known as side frames, casting elements, or plastic moldings that comprise a basic machine structure to fasten components). There is a plenum cover 44 (FIG. 6) secured to the plenum unit 40 (FIG. 5), having a top surface 44*b* which is disposed generally at a vertical level (FIG. 3) that is even with the horizontally disposed feeding deck 14. The plenum cover 44 is generally horizontal at the upstream end of the machine (near the input separation and feeding apparatus 20). There is a slight taper 44*a* to the downstream side of the plenum cover 44 (closer to the moistening area in the transport path) which will be discussed in more detail later in this specification.

Figure 4A:
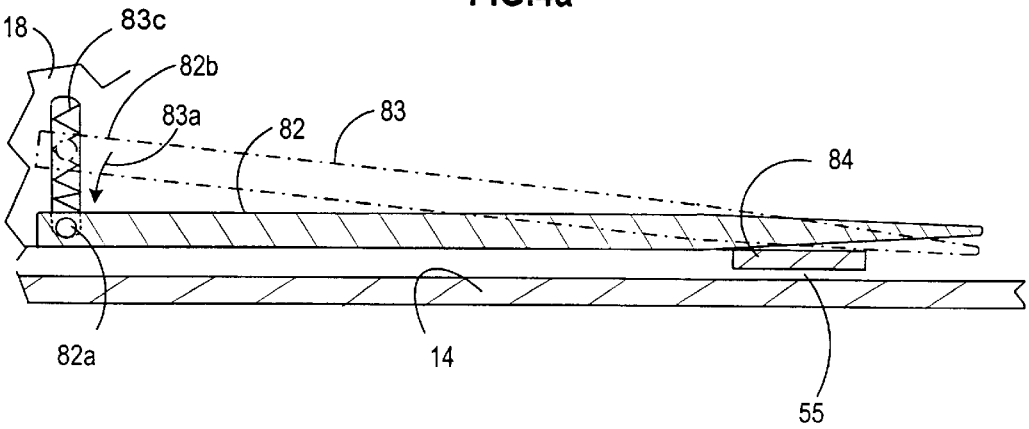
FIG. 4*a* is a partial section view taken along the lines of FIG. 4, showing details of the baffle guide used to guide mailpieces to a stripping or non-stripping position along the feed deck.
Figure 4:
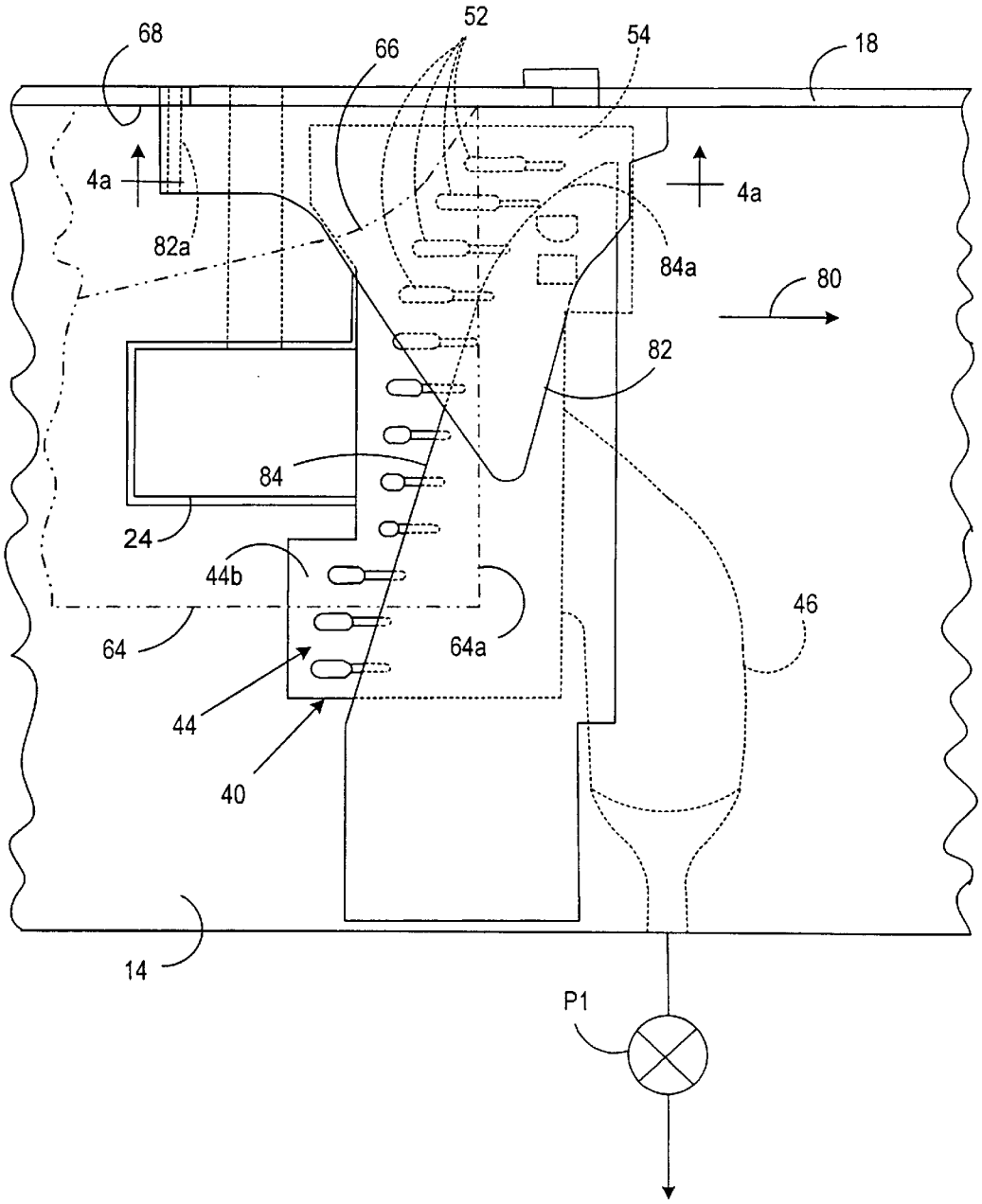
FIG. 4 is a plan view of the mailing machine of FIG. 1 showing the envelope transport and flap stripping area in accordance with the present invention.
Figure 5:
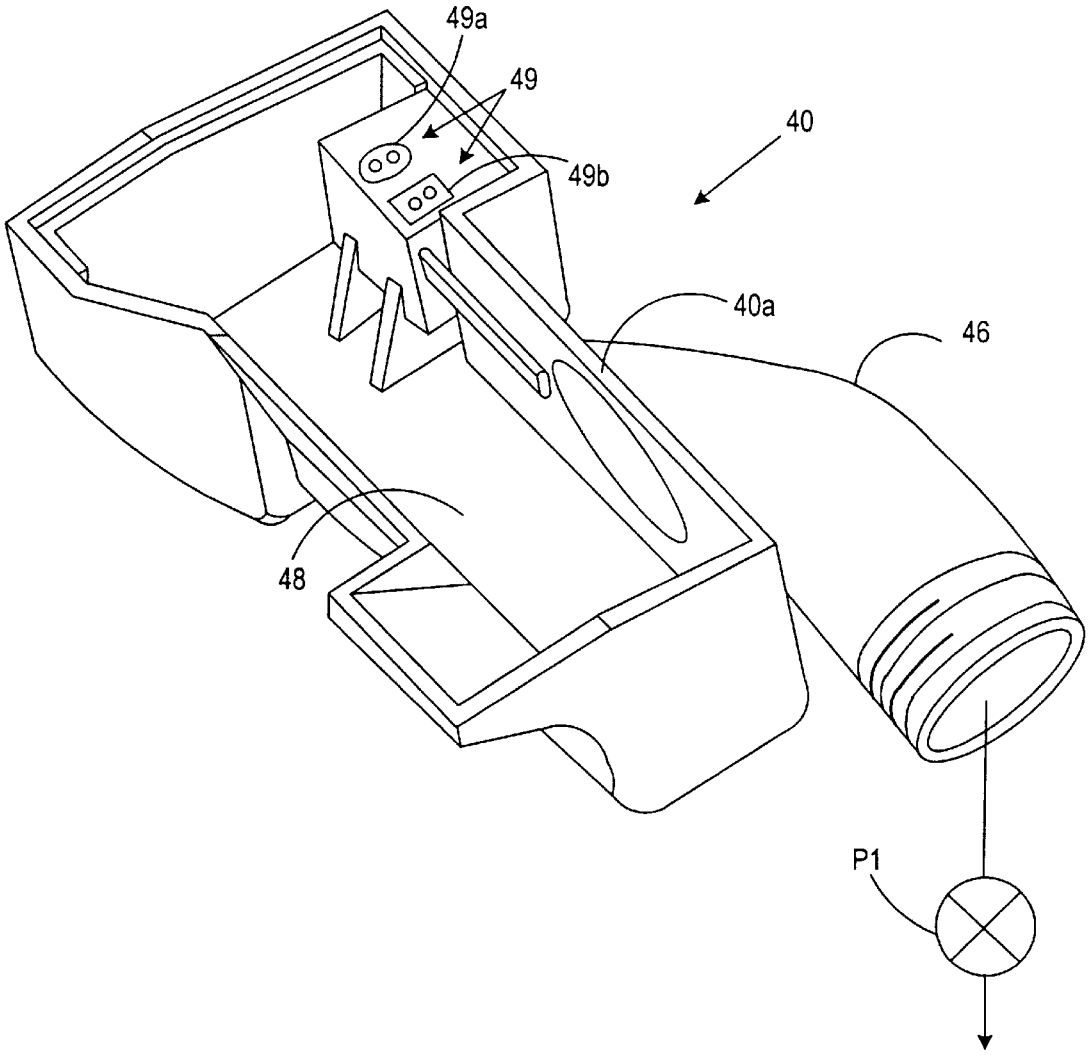
FIG. 5 is an enlarged perspective view of the plenum chamber of the present invention.

Referring to FIG. 3, and FIG. 5, the plenum unit 40 (shown in FIG. 5 without the plenum cover for clarity) has a vacuum supply manifold 46. The vacuum supply manifold 46 is molded in one piece along with the major bottom portion of the plenum unit 40. The manifold 46 is physically joined to the plenum unit 40 at a wall 40*a*. There is a vacuum pump P1 with appropriate duct supply devices (not shown) (FIG. 4 and 5), that supplies a vacuum equivalent to 4 inches of water. The amount of negative pressure may be varied as it has been in the case of the present invention to 2 inches or 6 inches of water, depending on other factors or the weight of envelope that is being stripped. The wall 40*a* is molded or formed as part of other sections and walls all making up the plenum unit 40 in the form of an integral box-like compartment 48 (FIG. 5). The plenum cover 44 is secured to the plenum unit through an ultrasonic assembly procedure (or may be glued with a suitable epoxy adhesive) to form a tight seal. It will be possible to design the plenum unit 40 as part of the feeding deck 14—that is for example, molded integrally in plastic. (This may be an alternate manufacturing design).

When sealed with the plenum cover 44, the plenum unit 40 is completed as is necessary for applying negative pressure in specific areas as will be defined in the present specification. The sealed plenum unit 40 insures that negative pressure applied will be directed through a parallel series of apertures 50 located in the plenum cover 44, (best seen in FIG. 4 and FIG. 6). The arrangement of the parallel series of apertures 50 is designed to hold down a spectrum of envelope flaps of envelopes of different sizes that pass over it. This will be discussed in more detail since it has been discovered that there is a need for greater flap holding force (negative pressure) along the plenum cover 44 in certain areas that may be identified with longer, wider or shorter envelope flaps.

There is a pair of sensors 49 located within the box like compartment 48 (FIG. 5). A first sensor 49*a* monitors the arrival of the leading edge of the media or envelope approaching the stripper blade 84. The first sensor 49*a* monitors the leading edge of the media or envelope prior to it encountering the stripper blade (explained later). A second sensor 49*b* is located within the box like compartment 48 and is utilized to monitor a bottom surface of the stripper blade (discussed later). The combination of sensors'49*a* and 49*b* are used to detect any malfunction in the progression of an envelope moving through the stripper and associated area. The area located between the sensors 49 and a window 50*a* in the plenum cover 44 is sealed from air leakage due to a close fit between the box-like compartment 48 and the plenum cover 44.

Figure 6:
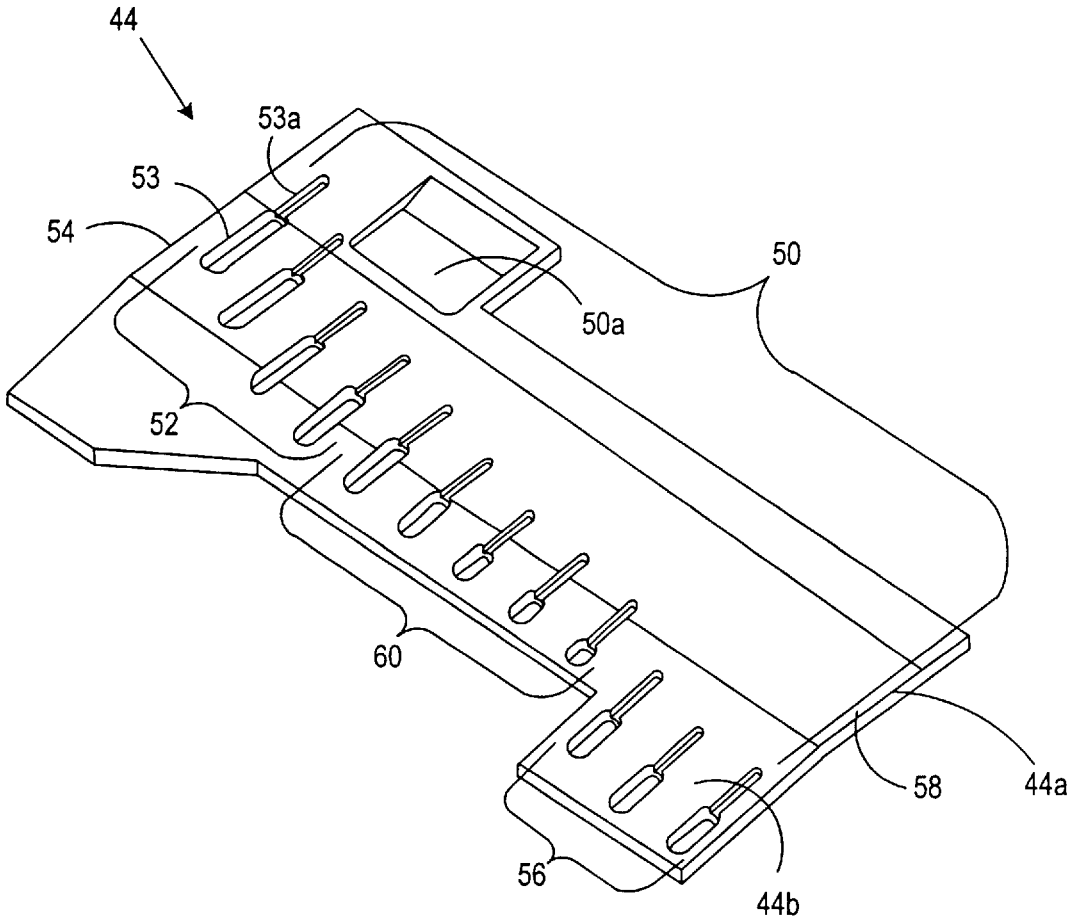
FIG. 6 is an enlarged perspective view of the plenum cover of the present invention.

Referring to FIG. 4, and FIG. 6 within the parallel series of apertures 50, there is a first group of plenum apertures 52, (or slots 52) located within the plenum cover 44 (the plenum cover in FIG. 6 is shown alone for clarity purposes). The first group of plenum apertures 52 is located at an inboard side 54 of the plenum cover 44 and the feeding deck 14 (next to the registration wall 18). There is a second group of plenum apertures 56 (or slots 56) located at an outboard side 58 of the plenum cover 44. There is a central group of plenum apertures 60 located between the first group 52 and the second group of plenum apertures 56. All plenum apertures that are covered by the envelope passing over the plenum cover 44 are used to hold down the envelope's flap that is joined to the body of each envelope being stripped.

There is a difference in the size (length as measured along the feeding deck) of the apertures which will affect the efficiency of how the envelope flap is held down. The size and/or length of the apertures may also be varied in accordance with the velocity of the mailpieces being processed.

The larger size (length) of the first group of apertures 52 for example is instrumental in holding down a shorter envelope flap (shorter meaning along the short side of the envelope). In addition, the length of the aperture or port of the parallel series of apertures 50 is extended through partial extensions that are molded into the plenum cover 44. The plenum cover 44 may be molded from a suitable plastic material, or may be manufactured from sheet metal or a die casting of metal such as zinc or aluminum. Molding of the plenum cover 44 and the other structural parts is presently a common way to manufacture such parts because of the cost efficiency and molding techniques available. The manufacturing processes currently available for the plenum unit makes the design and manufacture of the individual parts like the plenum cover 44 easy to accommodate forms, shapes and holes or relieved areas without machining. With this in mind, the apertures 52 are extended (but not broken through the thickness of the plenum cover), partially beyond the portion connected to the plenum unit 40 in order to help the flap holding function as will be explained in the following paragraph.

Figure 10:
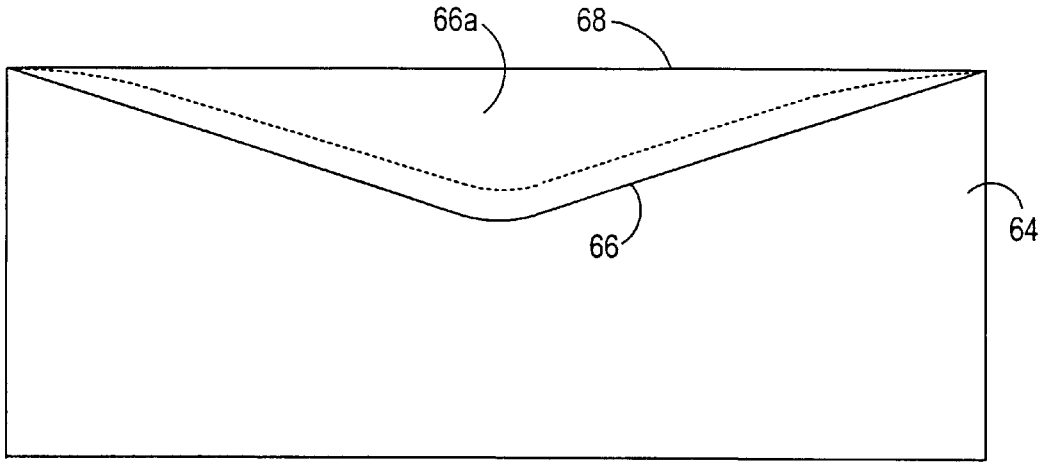
FIG. 10 is a plan view of the flap side of an envelope (such as a No. 10) having a V shaped flap.

In regards to the nature of the envelopes that may be processed in the machine 10, some such as a number 10 envelope have a V shaped flap, typically joined at the body of the upper side of the envelope. (FIG. 10 illustrates such an envelope). The depth and shape of each envelope flap may vary, as may the weight of the envelope itself depending on the material of fabrication. The depth, shape and the material/weight of the envelope flap may each contribute to a variable component that determines how much force it takes to hold down each envelope flap. And, depending on the speed of the transport system, the velocity of the envelope in transit may be affected by resisting air pressure at the leading end. That is, aerodynamic effects upon the very leading end of the envelope may deflect that end, or the flap to a position where it is difficult to separate it from the body of the envelope. Another effect that will tend to hold the flap to the envelope body may be a slight tendency for the glued portion of the envelope flap to stick to the body. Humidity or age of the envelope may be that kind of additional factor that requires better holding down of the flaps. In addition, depending on the stiffness of the paper, or the manufacturing process the envelope may present different characteristics that make it easy, or relatively difficult to hold down or open the flap from the body of an envelope. These effects or situations are resolved by the present invention in the application of the vacuum system.

Referring back to FIG. 4 and to FIG. 10 (where the envelope and associated parts are identified), there is an envelope 64 shown being processed through the stripping area of the machine 10, Using the example of the number 10 envelope, a flap 66 shown in FIG. 10 is hinged to the body of the envelope 64 at a longest portion 68, The flap 66 has an outside surface 66a that will be described later in position and acquisition with the plenum unit 40 as the flap 66 is attracted to the plenum cover 44 by vacuum. In FIG. 4, the longest portion 68 of the envelope 64 is seen registered against the registration wall 18 during transit.

Referring back to FIG. 6, there is an aperture (slot) 53, typical of all the apertures shown in FIG. 6. The slot 53 has an extension 53*a* that does not open into the box-like compartment 48 (vacuum chamber) of the plenum unit 40. The extended slot 53*a* is designed to maintain acquisition of the envelope flap as the envelope moves along the media or envelope feed path towards and through the stripper blade. The parallel series of apertures 50 all have some variation of length in the form of an extension similar to 53*a*, all of which contributes to maintaining the hold or acquisition of the envelope flap of the envelope being processed for as long as possible during transit.

Referring back to FIG. 4 and FIG. 6, the envelope 64 (from FIG. 10) is considered as it passes over the parallel series of apertures 50. It will be evident that the first group of apertures 52 engages the gap 66 (near the registration wall 18), in the stripping process. It will also be noted that the envelope flap 66 is shorter in the V direction, which presents more resisting force at the envelope's longest portion 68 (the seam joined to the body of the envelope) in order to pry the flap open from the body of the envelope. (If the V shape is longer the extended apex at the tip of the V helps in the separation process based on the principals of lever arms). In FIG. 4, the forces required to open the envelope flap 66 and hold it down remains as a higher resistance near the base of the V of the flap 66.

For this reason, the first group of apertures 52 is larger and longer thereby having increased open area than that of the central group of apertures 60. During the flap opening process, while the envelope 64 proceeds along the feed path, there will be a greater amount of atmospheric pressure holding the envelope flap 66 down along the lines of the first group of apertures 52. This is occurring because of the applied vacuum from within the vacuum unit 40, thereby enabling atmospheric pressure to hold the flap 66 down against the plenum cover 44. The result is that the envelope flap 66 is acquired on an outside surface 66*a*, and remains acquired while the envelope moves downstream in the feed path (defined as feed path 80). This affords the opportunity for a stripper blade 84 to engage the envelope flap 66 within an open space 55 (FIGS. 3 & 7) defined between the stripper blade 84 and the plenum cover 44.

Figure 11:
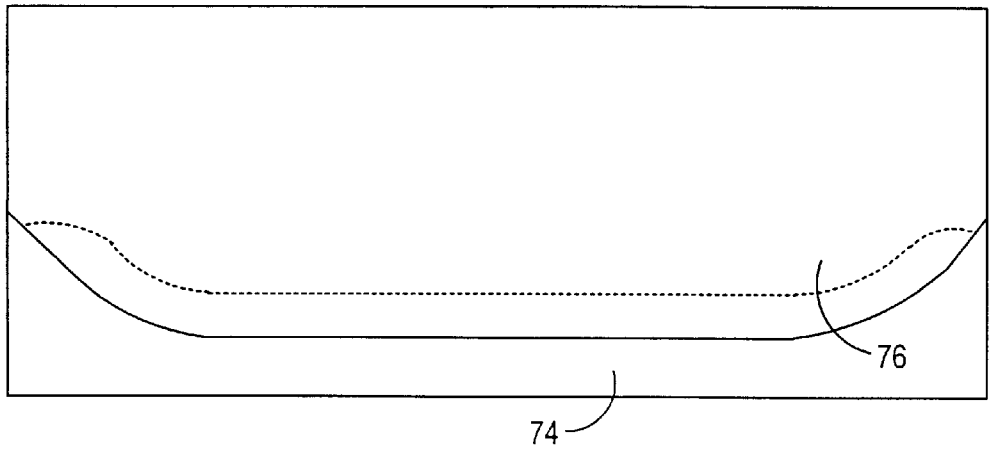
FIG. 11 is a plan view of the flap side of another envelope having a wider flap.

Mentioned previously in the present specification, the area defined by the entire outside surface 66*a* of the envelope flap 66 is typical of many envelopes processed in the mailing machine 10. It is typical in that the envelope flap is triangular shaped, and may be larger or smaller with a shorter V, or a longer and wider V shape depending on the envelope size being processed. The second group of apertures 56 will apply the same principal of applying a negative pressure to the flap such as that on an envelope 74 as shown in FIG. 11, the envelope 74 having a large flap 76 that is more trapezoidal in shape.

In this case where the envelope 74 is fed through the mailing machine 10, atmospheric pressure in combination with the negative pressure applied through the plenum unit 40 and the second group of apertures 56 will acquire the flap 76. (The apertures 50 in a sense create a flow of moving negative air, which in effect interacts with an envelope flap passing over them). The design of the plenum cover 44 has taken into consideration the potential spectrum size of mail or envelopes that are processed in the mailing machine 10 (and would apply to other similar types of equipment for stripping flaps). The design of the parallel series of apertures 50 is such that the first group of apertures is longer, as is the second group of apertures 56, both being illustrated as slots. The slots may be extended in length to suit or may be of many different shapes, including a teardrop shape, an oval shape, an oblong shape, a square shape, or even extended as a series of holes. Any shape may be applied as long as there is sufficient total aperture area to present to the envelope flap being acquired, held open and stripped. In addition, the apertures as shown in FIG. 6 are designed to be generally parallel to the registration wall 18, but may vary from this configuration as well. This may be accomplished in a configuration where the slots or apertures are not parallel to each other, or to a registration wall. Factors such as the shape of the plenum unit 40, the plenum cover 44, or other physical restraints may necessitate alternate alignments and position of the plenum apertures. It is also possible to leave the vacuum source on full time, with no need to switch the supply on and off. This may depend on energy requirements of the machine system.

STRIPPING OF AN ENVELOPE FLAP

Figure 2:
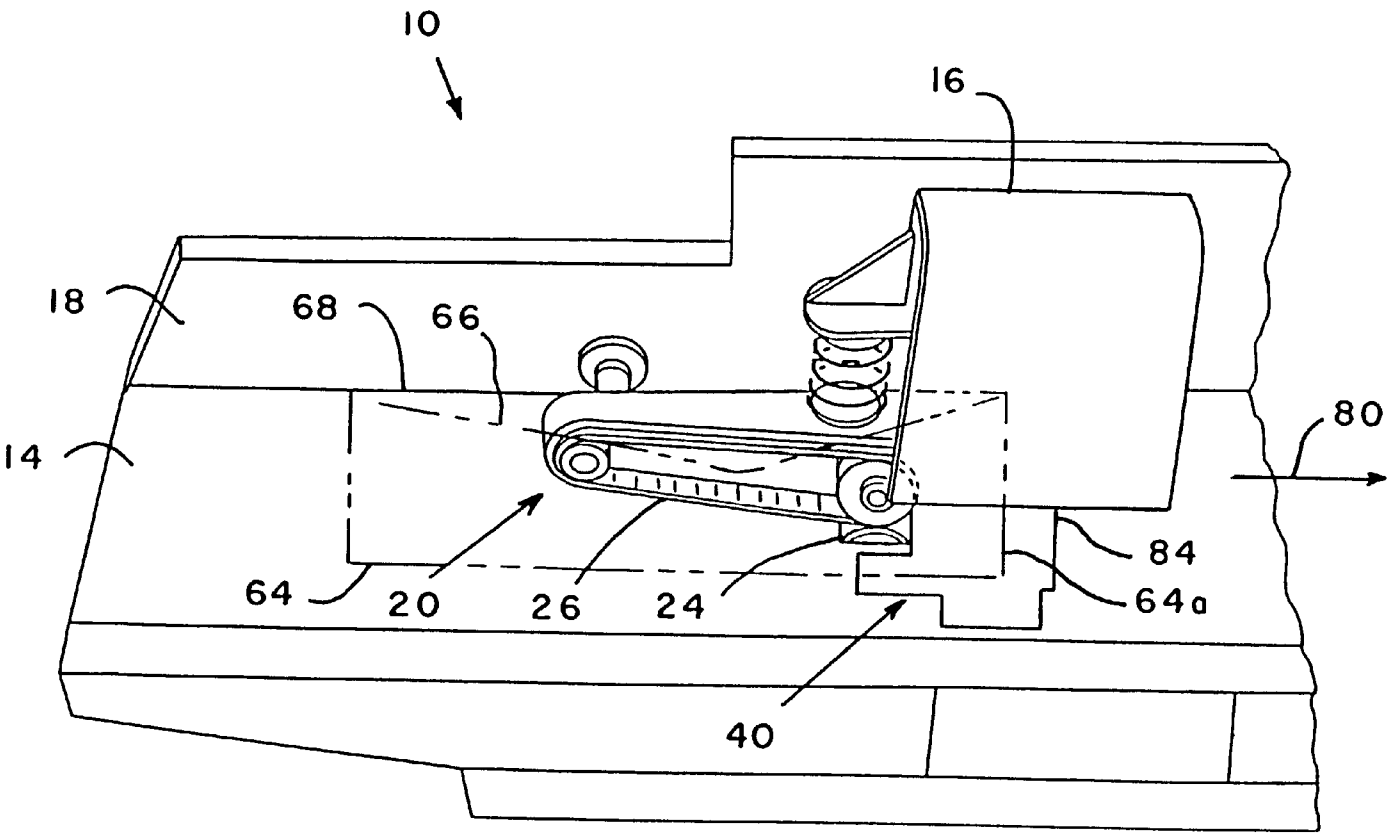
FIG. 2 is a front perspective view of the mailing machine in FIG. 1, showing the envelope transport deck.

Referring once again to FIG. 2, FIG. 3 and FIG. 4, the envelope 64 is shown being advanced through the mailing machine 10. The envelope 64 is aligned against the registration wall 18 at its longest portion 68. This is a typical function either produced by operator skill or automatically by aligning and registering devices (not shown). The feeding deck 14 provides the proper vertical alignment and guide surface for the envelopes or mail, and the input separation and feeding apparatus comprised of the overlying feeding belt and associated feeding roller 24 advances the envelope 64 along a downstream path 80 (FIG. 2 and FIG. 4). A leading end 64*a* of the envelope 64 moves towards the plenum unit 40, and the top surface 44*b* of the plenum cover 44 while a supply of vacuum air applies a negative pressure of 4 inches of water to the plenum unit 40 at the top surface 44*b*.

There is an envelope baffle guide 82 located adjacent to the registration wall 18, the guide 82 providing a slight amount of pressure to the top of the envelope in transit. The baffle guide 82 is actuated upon selection of a moistening function at the operator's keyboard (not shown). Normally, the baffle guide is down and generally vertically aligned with the feed deck 14, (FIG. 4*a*) thereby permitting envelopes and mailpieces to move over the stripping area of the machine. An actuation mechanism (not shown) is attached to the baffle guide at a pivot point 82*a*, which raises an input end 82*b* of the baffle guide 82 to a position 83 against a bias 83*a* from a biasing spring 83*c* thereby permitting the envelope 64 to be guided beneath the baffle guide 82. (Such a mechanism is described in U.S. Pat. No. 4,450,037 to Gavronsky mentioned earlier in this specification).

Figure 7:
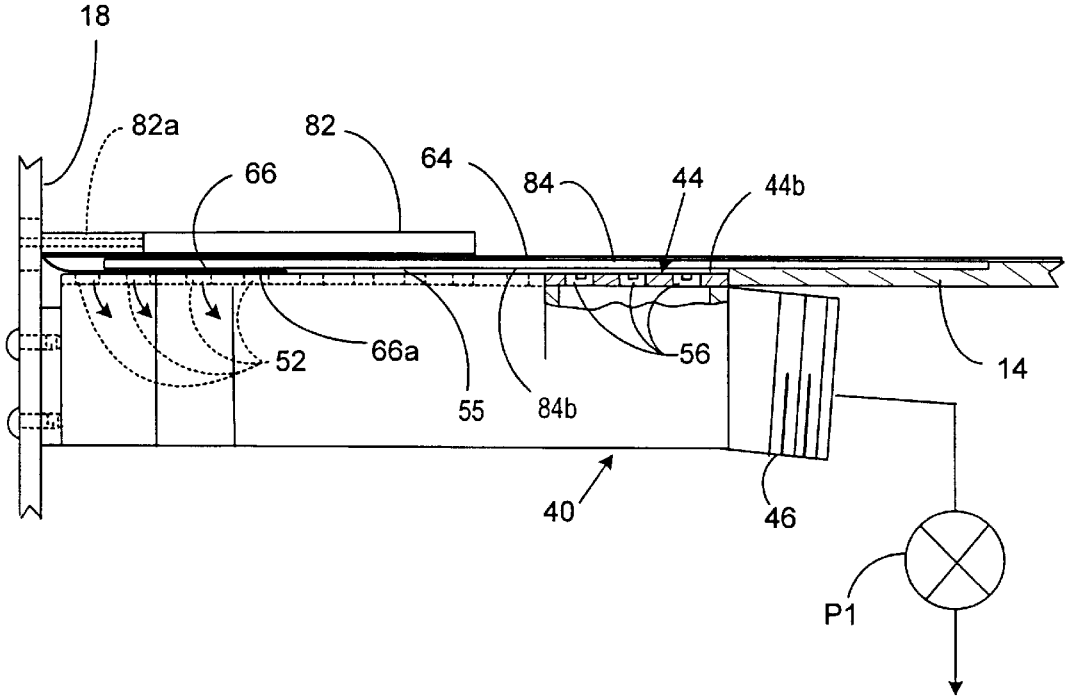
FIG. 7 is an elevation view taken from FIG. 4 of the plenum assembly and associated stripper blade of the present invention.

Referring to FIG. 4 and FIG. 7, the first group of apertures 52 engages the flap 66 of the envelope 64 on the outside surface 66*a* (FIG. 7), thereby pulling the flap 66 against the plenum cover 44. (All apertures being covered by an envelope flap contribute to holding the flap down.) Located immediately downstream and partially lying over the top of the plenum cover 44, there is a stripper blade 84. The stripper blade 84 has a typical curved shape 84*a*, (FIG. 4) defined in prior art of mailing equipment as being an effective shape needed to insert a stripping blade between the body of the envelope and the envelope flap. The curved shape 84*a* is designed to engage the flap so as to continue to hold it open once the flap is separated. The stripping blade 84 is slightly spaced apart from the taper surface 44*a* of the plenum cover 44, so that a bottom surface 84*b* (FIGS. 3 & 7) of the stripping blade 84 forms the gap or open space 55 which will receive an envelope flap once stripped. While the envelope 64 continues downstream along the feed path 80, the stripper blade 84 engages and guides the flap 66 through the open space 55 thereby stripping the flap 66 away from the body of the envelope 64. Immediately thereafter, the envelope engages a moistening apparatus (not shown) that applies the necessary sealant material to the glued portion of the flap 66.

ALTERNATE EMBODIMENT OF THE PRESENT INVENTION

Figure 8:
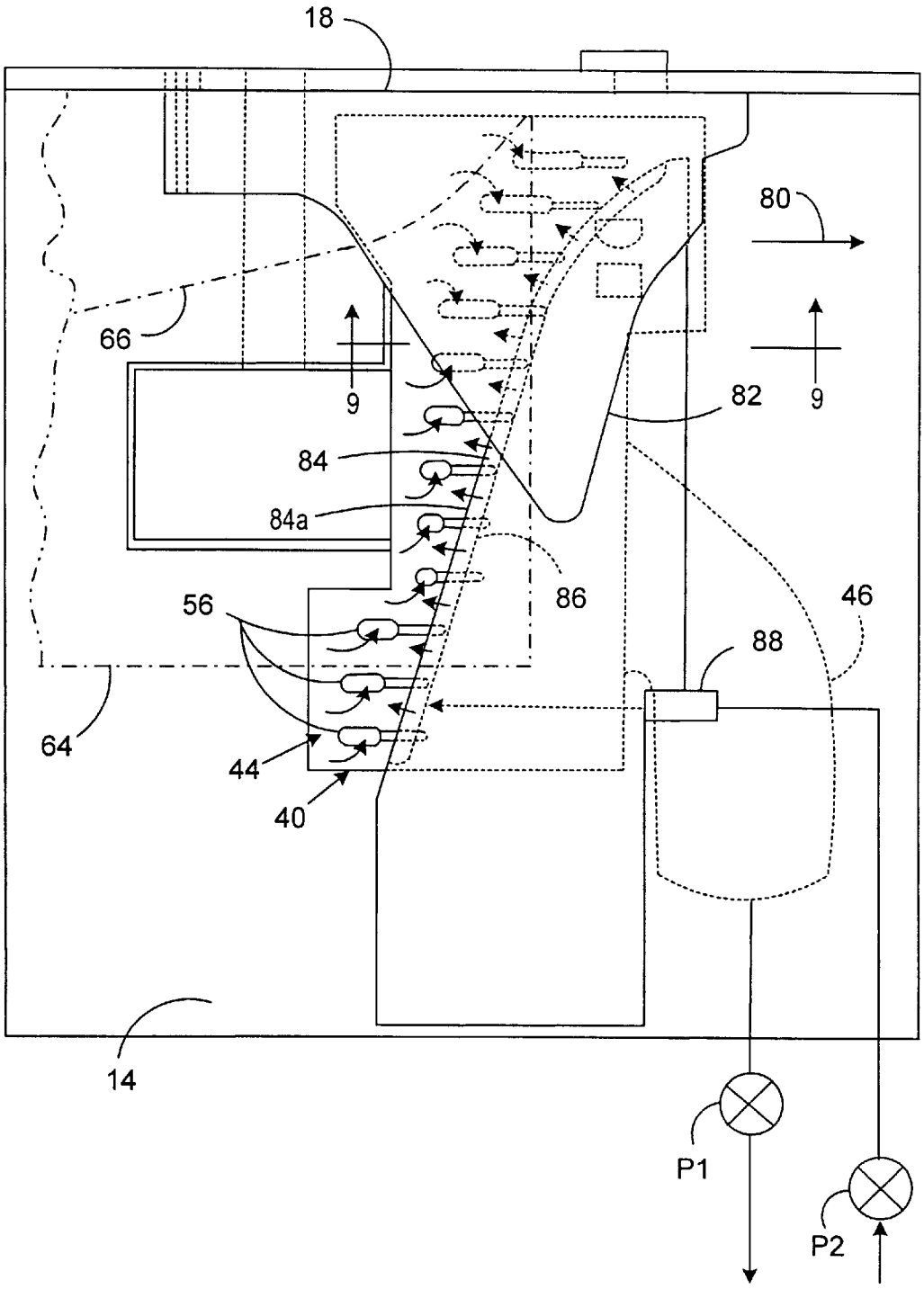
FIG. 8 is a plan view of the mailing machine of FIG. 1 showing an alternate embodiment using a vacuum plenum and positive air source in the envelope transport and flap stripping area in accordance with the present invention.
Figure 9:
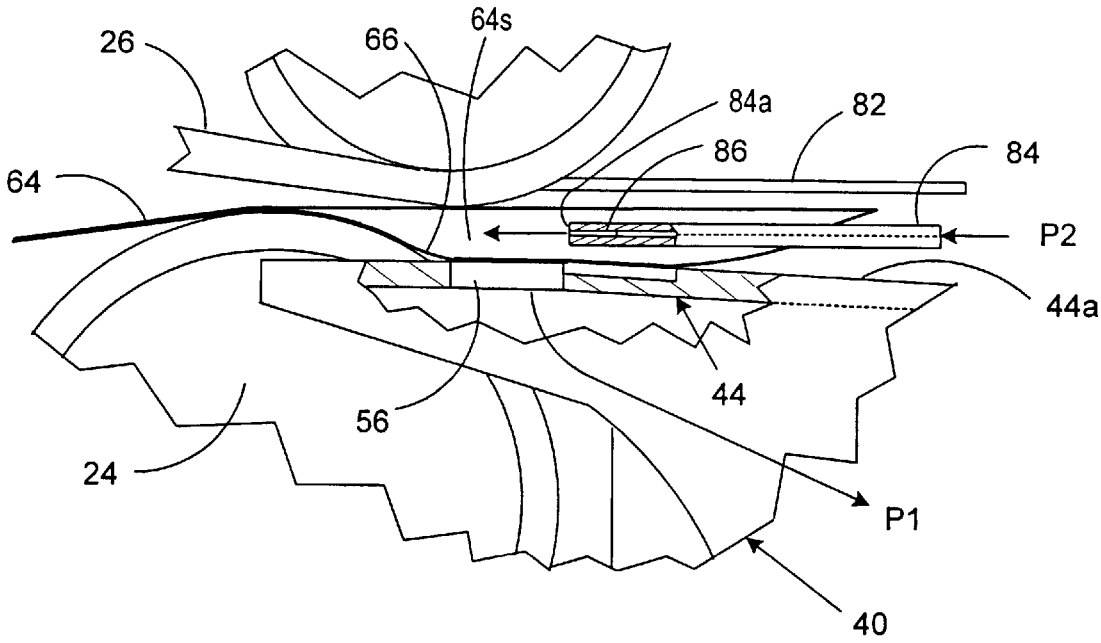
FIG. 9 is an enlarged elevation view taken along the lines of 9—9 from FIG. 8.

Referring now to FIGS. 8 & 9, there is shown the same plenum unit 44, and associated components, all provided as indicated previously with the embodiment shown in FIG. 3, and so forth. The system has a vacuum application system, the same as previously described in the present specification. The vacuum is applied through the vacuum supply manifold 46 in order to hold down the approaching envelope flaps of associated envelopes in the same manner as the previous embodiment described. The pump P1 delivers the same amount of reduced pressure, (about 4 inches of water). The stripper blade 84 is modified in this alternate embodiment since it is hollow in portions, and has a slit shaped port 86 along an edge 84*a* facing the oncoming envelopes or media streaming along the feed path. In FIGS. 8 & 9, the envelope 64 registered at the registration wall 18 is shown as it is positioned in the feed path 80. The envelope 64 is entering the stripping zone of the present invention in these figures.

The slit shaped port 86 may be designed as an elongated slotted port, an elongated port, a series of small apertures or an elongated aperture. The alternative shapes may be applied in the same general area as the slit shaped port 86, or any other shaped aperture that will permit the air to be positively directed towards the inner surface of the envelope flap 66. The stripper blade 84 has an appropriate inlet port 88, and a positive supply of air is forced through the hollow stripper blade 84 through a port 88. The port 88 connects appropriately by channels (not shown) to the slit shaped port 86. (The channels may be replaced by a empty space that would totally be included within the area of the stripper blade 84 and connected to the port 88 and the slit shaped port 86). There is a Pump P2 that supplies the positive air supply in the amount of approximately 4 inches of water. The positive air flows over an inside surface 64*s* of the envelope flap (FIG. 9) and helps to hold down the flap during advancement of the envelope downstream along the feed path 80. (The positive air forces the flap open regardless of the flap's exact shape and the combination of positive/negative pressure will enhance the air-flow configuration.) An arrow 90 (FIG. 9) represents the positive air flow directed towards the inside surface 84*s*.

The principal of Bernoulli's theorem is utilized in the application of the positive and negative air supplies. The principal basically permits atmospheric pressure to help hold the envelope flap down as the flap moves towards the stripper blade 84. The addition of the positive air supply will enhance the design of the stripping apparatus disclosed herein, especially in the case of heavy-duty envelopes fabricated with stiff material or having an extra large lap that is heavy because of the material.

In FIG. 9, the relationship of the stripper blade 84 to the plenum unit 40, and a tapered surface 44*a* of the plenum cover 44 is shown. The tapered surface 44*a* helps provide a space to fit the relatively thin stripper blade 84 into the vertical arrangement of all components that are utilized for the stripping function. (FIG. 9 is slightly distorted to show the relationships defined with the tapered surface 44*a* to the stripper blade 84, since the stripper blade may be positioned vertically much closer to the surface 44*a* as is physically possible).

ANOTHER ALTERNATE EMBODIMENT OF THE PRESENT INVENTION

Figure 12:
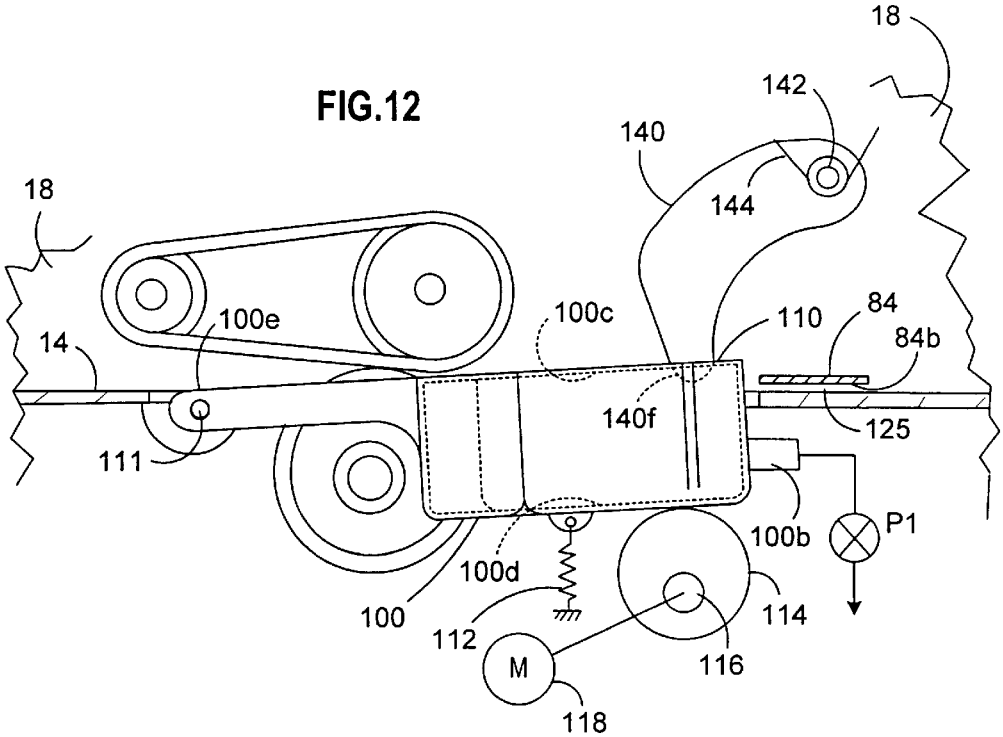
FIG. 12 is an elevation view taken along the lines of FIG. 1 showing another alternate embodiment of the present invention utilizing a pivotable deflector and the inclusive vacuum plenum.

Referring to FIG. 12, 12*a* & 13, the arrangement of components of the stripping apparatus is slightly different than the previous two embodiments as will be explained in the following detailed description and example. There is a pivotable deflector 100 (also may be called a positionable deflector, or a pivot shield) positioned in line or slightly above the feeding deck 14 so as to surround the feeding roller 24. This permits the deflector to be positioned in one of two orientations or positions while permitting the feeding apparatus to advance the mailpieces or envelopes. The position shown in FIG. 12 is a non-stripping position 110 that is raised up away from the feeding deck 14 in order to deflect an on coming envelope up and over the stripper blade 84. There is a shaft 111 located at an input end 100*e* of the pivotable deflector 100, (which may be molded into the deflector 100), and suitable journals in the registration wall 18 and the feeding deck 14. This arrangement permits the deflector to pivot between the described positions.

Figure 12A:
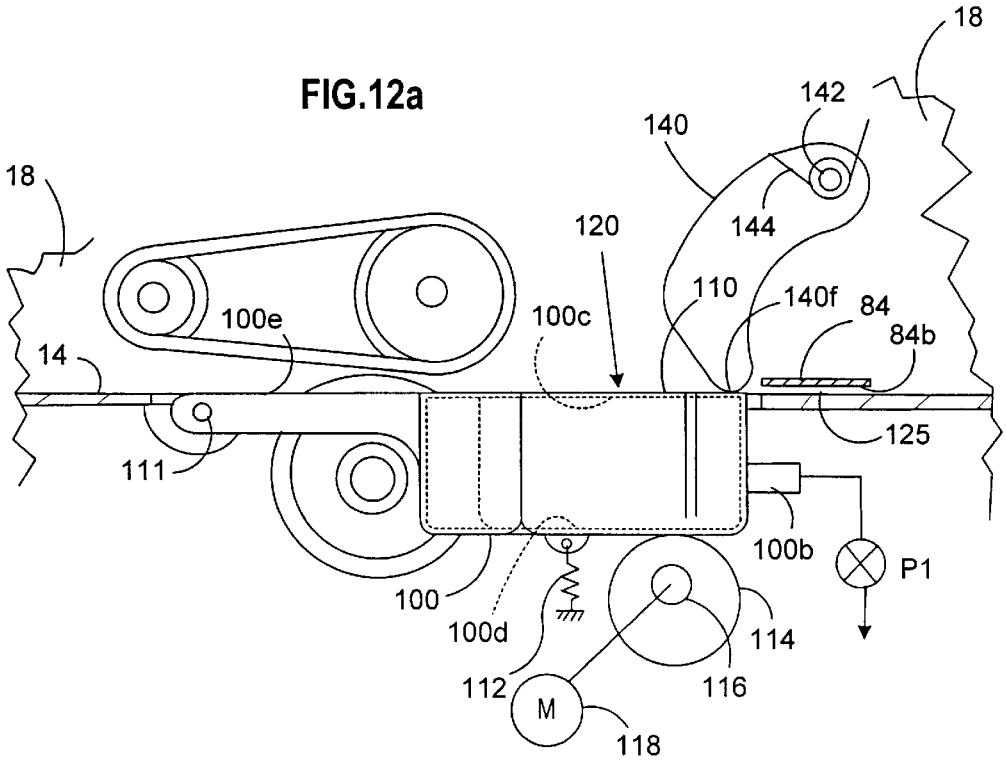
FIG. 12*a* is an elevation view taken along the same lines as FIG. 12, showing the lowered position of the pivoting deflector and inclusive vacuum plenum.
Figure 13:
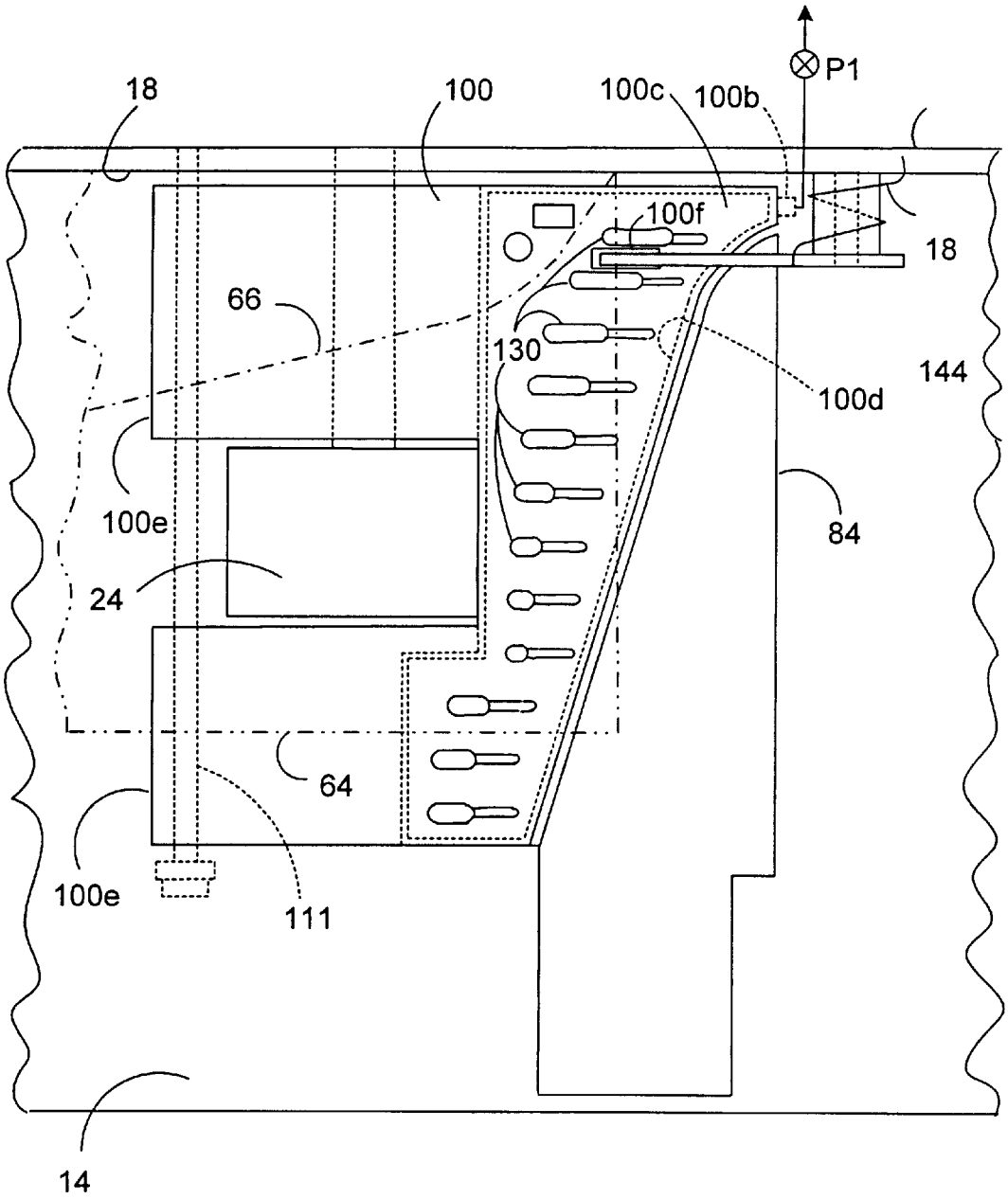
FIG. 13 is a plan view of the alternate embodiment of FIG. 11

The position of the deflector 100 is determined by a biasing spring 112 so that the deflector 100 is held against a positionable cam 114, that is mounted on a support shaft 116. There is an electric motor 118 suitably attached to the shaft 116, and this effects the position of the pivotable deflector 100 to a stripping position 120 (FIG. 12*a*). In position 120 a top surface 100*a* of the pivotable deflector 100 is lowered to provide a gap 125 (Same as gap 55 previously described), which permits an envelope flap to pass beneath the bottom surface 84*b* of the stripper blade 84. The motor 118 may rotate the cam 114 180 degrees to the non stripping position as required with an operator's input at the operator panel of the machine (not shown). The stripping/non stripping or moistening/non-moistening functions are controlled at the operator panel depending on the need. It will be recognized that the cam 114 may be manually operated by a lever arm that would be connected to the cam 114 or the support shaft 116.

The pivotable deflector 100 is also a vacuum chamber, (like the plenum unit 40 previously described). A vacuum supply of 4 inches of water is supplied through a port 100*b*, which is in turn connected to the pump P1. The pivotable deflector 100 has a sealed chamber 100*d*, and a cover 100*c*, having a series of parallel apertures 130, which are designed for the same effect as that described for the prior embodiment and the parallel series of apertures 50 associated with the plenum unit 40. The function of providing sufficient vacuum supply when the pivotable deflector is in the stripping position 120 is also the same as described in the earlier embodiments. The apertures 130 are directly connected to the chamber, 100*d* defined as being formed within the deflector 100. While the function remains the same as that previously described in that the longest apertures will retain the envelope flaps that are short and also longer in the V direction, with the central apertures retaining all envelope flaps that may range in between. In addition, there is a pivotable and biased deflector finger 140 mounted on a suitable pin 142 secured to the registration wall 18. A torsion spring 144 biases the deflector finger 140 against the top surface of an envelope passing beneath the finger 140. When envelopes are in the feed path, the finger 140 is holding the flap area of the envelopes down against the pivotable deflector 100. When there is no envelope beneath the finger 140, a tip 140*f* of the finger 140 passes through a slot 100*f* in the deflector 100. The finger 140 is lightly loaded by the torsion spring so as not to inadvertently damage the lighter type of mailpiece or envelope. Referring to FIG. 12, it will be recognized that the finger 140 is shaped to engage and hold down a leading end of each mailpiece being transported through a receiving path 116 located in the stripping zone of the machine. The finger 130 is arranged slightly spaced from the registration wall 18 in order to help achieve a desired holding function at a position relatively close to the registration wall in order for the mailpieces to be properly stripped at an optimum position.

There may be other combinations of the stripping elements that can be applied to the system as described in all of the embodiments described in this specification as will be evident by those skilled in the art. Therefore, the preceding detailed specification, drawings, and description of same sets forth examples of how the envelope flap stripping apparatus will function in handling mail, mailing envelopes and envelopes in envelope processing equipment where the flap must be separated from the body of an envelope.

Further advantages and modifications will readily occur to those skilled in the art. Therefore, in its broader aspects, the invention is not limited to the specific details, and representative devices shown and described herein. Accordingly, various modifications may be made without departing from the spirit or scope of the general inventive concept as defined by the appended claims.

What is claimed is:

1. An envelope stripping apparatus, comprising:

an envelope transport mechanism including a support frame;

a vacuum plenum having a plenum cover including a series of plenum apertures, the vacuum plenum and plenum cover being positioned and secured to the support frame so as to engage an envelope flap of an envelope moving along the transport mechanism, the series of plenum apertures including a parallel series of slotted openings laterally spaced apart so as to engage any associated envelope flap of a spectrum of varying sized envelopes, the slotted openings each being substantially parallel to a registration wall of the envelope transport mechanism, the slotted openings being elongated such that a first group of slots located adjacent to the registration wall is longer than a second group of slots located at an outboard side of the plenum cover, and;

an envelope stripping blade mounted to the support frame in a downstream position relative to the parallel series of plenum apertures so that the stripping blade lies substantially parallel and spaced apart from the plenum cover in order to intercept and strip the envelope flap.

2. An envelope stripping apparatus as recited in claim 1, wherein the slotted openings are located within the plenum cover in an uncovered longitudinal upstream position with respect to a flap receiving edge of the envelope stripping blade.

3. An envelope stripping apparatus as recited in claim 1, wherein the plenum cover has a horizontal upstream surface, and an angled downstream surface, the angled downstream surface residing substantially below the envelope stripper blade and spaced apart from the stripper blade for accepting the envelope flap of a transported envelope while avoiding the envelope flap in a non-vacuum feeding cycle.

4. An envelope stripping apparatus as recited in claim 3, wherein the plenum cover has a horizontal upstream surface, and a relieved downstream surface forming a vertical space for locating the envelope stripper blade into a substantially parallel, spaced relationship with respect to the relieved downstream surface of the plenum cover; the parallel, spaced relationship thereby providing an envelope flap receiving position of the stripper blade for intercepting an envelope flap of a transported envelope while avoiding the envelope flap in a non-vacuum feeding cycle.

5. An envelope stripping apparatus, comprising:

an envelope transport mechanism including a support frame, and;

a hollow envelope stripping blade fixedly mounted to the support frame, the hollow envelope stripping blade having a slit shaped port that is oriented to intercept an inner surface of an envelope flap of an oncoming envelope approaching the hollow envelope stripper blade with positive pressure in order to produce a Bernoulli effect upon the envelope flap thereby holding the envelope flap down during advancement of the envelopes towards the stripper blade.

6. An envelope stripping apparatus as recited in claim 5, wherein the slit shaped port is located at an upstream end of the hollow envelope-stripping blade facing an oncoming envelope flap.

7. An envelope stripping apparatus, comprising:

an envelope transport mechanism including a support frame;

a vacuum plenum having a plenum cover including a parallel series of plenum apertures, the vacuum plenum and plenum cover being positioned and secured to the support frame so as to engage an envelope flap of an envelope moving along the transport mechanism, and;

a hollow envelope stripping blade having at least one port that applies a positive pressure to an inside surface of the envelope flap while simultaneously applying a negative pressure to an outside surface of the envelope flap, thereby holding and positioning the envelope flap in an open position during advancement of the envelope towards a receiving path including the hollow envelope stripping blade.

8. An envelope stripping apparatus as recited in claim 7 wherein the one port is at least one elongated aperture.

* * * * *